US008256214B2

(12) United States Patent
Rioli et al.

(10) Patent No.: US 8,256,214 B2
(45) Date of Patent: Sep. 4, 2012

(54) INTERNAL COMBUSTION ENGINE WITH DEACTIVATION OF PART OF THE CYLINDERS AND CONTROL METHOD THEREOF

(75) Inventors: Mauro Rioli, Sassuolo (IT); Luca Poggio, Casalecchio di Reno (IT)

(73) Assignee: Ferrari S.p.A., Modena (IT)

( * ) Notice: Subject to any disclaimer, the term of this patent is extended or adjusted under 35 U.S.C. 154(b) by 747 days.

(21) Appl. No.: 11/886,981

(22) PCT Filed: Mar. 24, 2006

(86) PCT No.: PCT/IB2006/000659

§ 371 (c)(1),
(2), (4) Date: Jun. 19, 2009

(87) PCT Pub. No.: WO2006/100575

PCT Pub. Date: Sep. 28, 2006

(65) Prior Publication Data

US 2009/0282807 A1 Nov. 19, 2009

(30) Foreign Application Priority Data

Mar. 25, 2005 (IT) ..... BO2005A0193

(51) Int. Cl.
*F01N 1/00* (2006.01)

(52) U.S. Cl. ..... 60/324; 60/274; 60/285; 60/287; 60/292; 123/90.15; 123/90.16

(58) Field of Classification Search ..... 60/274, 60/285, 287, 292, 324; 123/90.15, 90.16
See application file for complete search history.

(56) References Cited

U.S. PATENT DOCUMENTS

| | | | | |
|---|---|---|---|---|
| 4,107,921 | A * | 8/1978 | Iizuka | 60/288 |
| 4,467,602 | A | 8/1984 | Iizuka et al. | |
| 5,582,004 | A * | 12/1996 | Rutschmann | 60/288 |
| 5,956,949 | A * | 9/1999 | Mayer et al. | 60/301 |
| 6,295,806 | B1 * | 10/2001 | Poublon et al. | 60/274 |
| 6,938,410 | B2 * | 9/2005 | Glugla et al. | 60/284 |
| 7,640,728 | B2 * | 1/2010 | Yoshizaki et al. | 60/286 |
| 7,856,815 | B2 * | 12/2010 | Demura et al. | 60/324 |
| 7,941,994 | B2 * | 5/2011 | Surnilla et al. | 60/285 |
| 8,056,337 | B2 * | 11/2011 | Hokuto et al. | 60/602 |
| 2002/0026789 | A1 | 3/2002 | Morinaga et al. | |
| 2004/0098970 | A1 | 5/2004 | Foster | |

FOREIGN PATENT DOCUMENTS

EP 0 802 315 A 10/1997

OTHER PUBLICATIONS

International Search Report for PCT/IB2006/000659 dated Sep. 6, 2006.

* cited by examiner

*Primary Examiner* — Thomas Denion
*Assistant Examiner* — Jesse Bogue
(74) *Attorney, Agent, or Firm* — Bryan A. Santarelli; Graybeal Jackson LLP

(57) ABSTRACT

Internal combustion engine provided with a plurality of cylinders divided into a first group and a second group; a control unit for deactivating all the cylinders of the second group; a first exhaust conduit and a second exhaust conduit, which are reciprocally connected at an intersection and which are respectively connected to cylinders of the first group and to cylinders of the second group; a catalyzer, which is arranged along the first exhaust conduit upstream of the intersection and is provided with first sensors for detecting the exhaust gases; and a second catalyzer, which is arranged downstream of the intersection and is provided with second sensors for detecting the exhaust gas composition.

28 Claims, 6 Drawing Sheets

INTERNAL COMBUSTION ENGINE WITH DEACTIVATION OF PART OF THE CYLINDERS AND CONTROL METHOD THEREOF

PRIORITY CLAIM

This application claims priority to PCT Application No. PCT/IB2006/000659, filed Mar. 24, 2006, which claims priority to Italian Patent Application No. BO2005A000193, filed Mar. 25, 2005, which are incorporated herein by reference.

TECHNICAL FIELD

An embodiment of the present invention relates to an internal combustion engine with deactivation of part of the cylinders and a control method thereof.

BACKGROUND

An internal combustion engine comprises a plurality of cylinders, which are either arranged in line in a single row or are divided into two reciprocally angled rows. Generally, relatively low displacement engines (typically up to two liters) have a limited number of cylinders (usually four, but also three or five) arranged in line in a single row; conversely, higher displacement engines (more than two liters) have a higher number of cylinders (six, eight, ten or twelve) divided into two reciprocally angled rows (the angle between rows is generally from 60° to 180°).

A high displacement engine (more than two liters) is capable of generating a high maximum power, which however during normal driving on roads is rarely exploited; particularly when driving in cities, the engine generates a very limited power, which is a limited fraction of the maximum power in the case of a high displacement engine. It is inevitable that when a high displacement engine outputs limited power, such power output occurs at very low efficiency, and with a high emission of pollutants.

It has been proposed to deactivate some (usually half) of the cylinders in a high displacement engine when the engine is required to generate limited power; in this way, the cylinders which remain active may operate in more favorable conditions, increasing the total engine efficiency and reducing the emission of pollutants.

According to the currently proposed methods, in order to deactivate a cylinder, injection is cut off in the cylinder (i.e. the corresponding injector is not controlled) and either both the corresponding suction valves and the corresponding exhaust valves are maintained in an open position or only the corresponding suction valves are maintained in a closed position. A mechanical decoupling device is required to keep a valve in a closed position, the device being adapted to decouple the valve from the respective camshaft. However, such mechanical decoupling devices are complex and costly to make, particularly in high maximum revolution speed engines; furthermore, such mechanical decoupling devices inevitably entail increased weight of the moving parts, with consequent increase of inertial stress to which the distribution system is subjected.

Generally, in an engine whose cylinders are arranged in two rows, a respective throttle valve arranged upstream of an intake manifold of the row is associated with each row; furthermore, a respective catalyzer arranged downstream of an exhaust manifold of the row is associated with each row. It is convenient to deactivate all of the cylinders of a row in order to deactivate part of the engine cylinders; however, in this case the catalyzer associated with the deactivated row tends to cool down as it is no longer crossed by the hot exhaust gases from the row. When the row is reactivated, the catalyzer is cold and therefore presents very low efficiency for a significant, not negligible time.

U.S. Pat. No. 4,467,602A1 discloses a split engine control system operating a multiple cylinder internal combustion engine by using only some of the plurality of cylinders under light load conditions. The total number of cylinders are split into a first cylinder group which is always activated during engine operation and a second cylinder group which is deactivated under light load conditions. The engine is provided with an exhaust passage which consists of first and second upstream exhaust passages connected to the first and second cylinder group, respectively, and a common downstream exhaust passage; an exhaust gas sensor and a first catalytic converter are disposed in the first upstream exhaust passage, and a second catalytic converter is disposed in the common downstream exhaust passage.

SUMMARY

An embodiment of the present invention is an internal combustion engine with deactivation of part of the cylinders and a control method thereof, which engine and method are easy and cost-effective to implement and, at the same time, are free from the drawbacks described above.

BRIEF DESCRIPTION OF THE DRAWINGS

One or more embodiments of the present invention will now be described with reference to the accompanying drawings illustrating some non-limitative exemplary embodiments thereof, in which.

DETAILED DESCRIPTION

Figure 1:
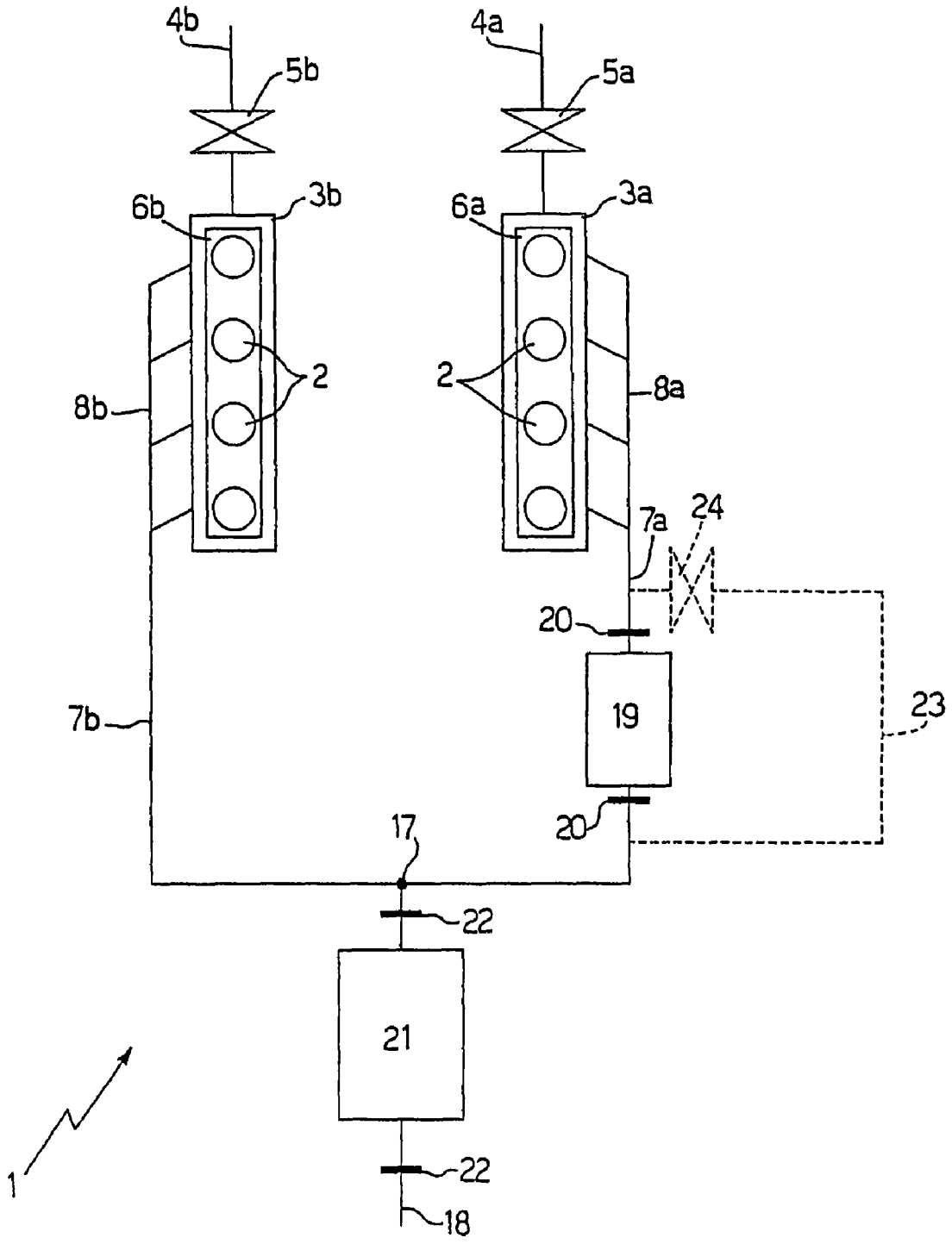
FIG. 1 is a schematic view of an internal combustion engine with deactivation of part of the cylinders made according to an embodiment of the present invention.

In FIG. 1, it is indicated as a whole by 1 an internal combustion engine for a motor vehicle (not shown), whose engine 1 comprises eight cylinders 2 arranged in two rows 3*a* and 3*b* which form a 90° angle therebetween.

The engine 1 further comprises an intake conduit 4*a* and an intake conduit 4*b*, which are respectively connected to cylinders 2 of row 3*a* and to cylinders 2 of row 3*b* and are respectively controlled by a throttle valve 5*a* and a throttle valve 5*b*. In particular, the cylinders 2 of row 3*a* are connected to intake conduit 4*a* by means of an intake manifold 6*a*, and the cylinders 2 of row 3*b* are connected to intake conduit 4*b* by means of an intake manifold 6*b*.

The cylinders 2 of row 3*a* are connected to an exhaust conduit 7*a* by means of a single exhaust manifold 8*a*, and the cylinders 2 of row 3*b* are connected to an exhaust conduit 7*b* by means of a single exhaust manifold 8*b*.

Figure 2:
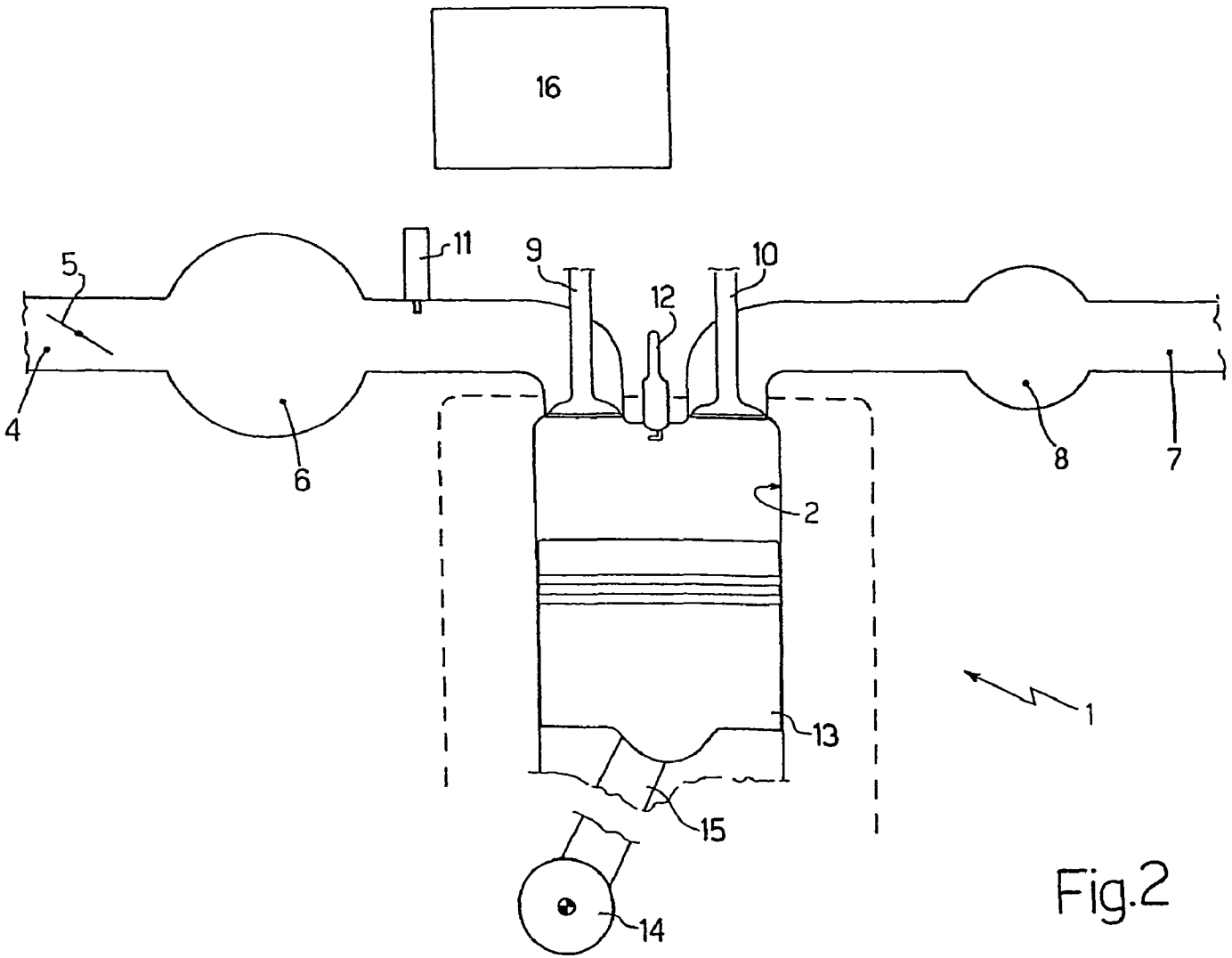
FIG. 2 is a schematic and partial side section of a cylinder in the engine of FIG. 1.

As shown in FIG. 2, each cylinder comprises at least one suction valve 9 to regulate the flow of intake air from the intake manifold 6 and at least one exhaust valve 10 to regulate the flow of exhaust air to the exhaust manifold 8. Furthermore, each cylinder 2 comprises an injector 11 for cyclically injecting fuel within the cylinder 2 itself; according to different embodiments, the injector 11 may inject fuel within the intake manifold 6 (indirect injection) or within the cylinder 2 (direct injection). A spark plug 12 is coupled to each cylinder 2 to determine the cyclic injection of the mixture contained within the cylinder 2 itself; obviously, in the case of a diesel powered internal combustion engine 1, the spark plugs 12 are not present.

Each cylinder 2 is coupled to a respective piston 13, which is adapted to linearly slide along the cylinder 2 and is mechanically connected to a crankshaft 14 by means of a connecting rod 15; according to different embodiments, the crankshaft 14 may be "flat" or "crossed".

The engine 1 finally comprises an electronic control unit 16 which governs the operation of the engine 1, and in particular is capable of deactivating the cylinders 2 of the row 3*b* when limited power output is required from the engine 1; in this way, the cylinders 2 of the row 3*a* which remain operational may work in more favorable conditions, thus increasing the overall efficiency of the engine 1 and reducing the emission of pollutants. In other words, the cylinders 2 of the engine 1 are divided into two groups coinciding with the two rows 3 and, in use, the cylinders 2 of a group coinciding with the row 3*b* may be deactivated.

According to an embodiment, in order to deactivate the cylinders 2 of row 3*b*, the electronic control unit 16 cuts off fuel supply to the cylinders 2 of row 3*b* acting on the injectors 11 without in any way-intervening on the actuation of the suction and exhaust valves 9 and 10, which continue to be operated. In other words, in order to deactivate the cylinders 2 of row 3*b*, the electronic control unit 16 cuts off fuel supply to the cylinders 2 of row 3*b* and does not perform any type of intervention on the actuation of the suction and exhaust valves 9 and 10. According to an embodiment, no intervention is performed on the spark plugs 12 of the cylinders 2 of row 3*b*, which are normally controlled also in the absence of fuel; such choice is made to simplify the control and to keep the electrodes of the spark plugs 12 clean, and therefore fully efficient. According to a different embodiment, the spark plugs 12 of the cylinders 2 of row 3*b* are controlled at reduced frequency as compared to normal operation.

During the operation of the engine 1, the electronic control unit 16 decides whether to use all the cylinders 2 to generate the motive torque or whether to deactivate the cylinders 2 of row 3*b* and therefore use only the cylinders 2 of row 3*a* to generate the motive torque. Generally, the cylinders 2 of row 3*b* are deactivated when the engine 1 is requested to generate a limited power and it is provided that the demand for power is not subject to sudden increases over the short term. It is important to stress that, once verified, there may exist various conditions causing the deactivation of cylinders 2 of row 3*b* to be either excluded or considerably limited; by way of example, the cylinders 2 of row 3*b* are not deactivated when the engine 1 is cold (i.e. when the temperature of a coolant fluid of the engine 1 is lower than a certain threshold), in the case of faults and malfunctioning, or when the driver adopts a sporty or racing driving style.

As shown in FIG. 1, exhaust conduit 7*a* and exhaust conduit 7*b* are connected together at an intersection 17, in which exhaust conduit 7*a* and exhaust conduit 7*b* are joined to form a common exhaust conduit 18.

Along exhaust conduit 7*a*, a catalyzer 19 is arranged between exhaust manifold 8*a* and intersection 17 (i.e. upstream of intersection 17) and provided with sensors 20 for detecting the composition of exhaust gases upstream and downstream of the catalyzer 19 itself. Preferably, sensors 20 comprises a UEGO lambda sensor 20 arranged upstream of the catalyzer 19 and an ON/OFF lambda sensor arranged downstream of the catalyzer 19.

A catalyzer 21 is present along the common exhaust conduit 18 (i.e. downstream of intersection 17) whose nominal capacity is double that of catalyzer 19 and which is provided with sensors 22 for detecting the composition of exhaust gases upstream and downstream of the catalyzer 21 itself. Sensors 22 comprise a UEGO lambda sensor 22 arranged upstream of the catalyzer 21 and an ON/OFF lambda sensor arranged downstream of the catalyzer 21.

The operation of the engine shown in FIG. 1 is described below.

When all the cylinders 2 of the engine 1 are active, the exhaust gases generated by the cylinders 2 of the row 3*a* cross the catalyzer 19; consequently, the electronic control unit 16 uses the signals provided by the sensors 20 to control the combustion within the cylinders 2 of row 3*a*. Furthermore, when all the cylinders of the engine 1 are active, the exhaust gases generated by the cylinders 2 of row 3*b* cross the catalyzer 21 along with the exhaust gases generated by the cylinders 2 of row 3*a;* consequently, the electronic control unit 16 uses the difference between the signals provided by the sensors 22 and the signals provided by the sensors 20 (i.e. performs a differential reading) to control combustion within the cylinders 2 of row 3*b*.

When all the cylinders 2 of row 3*b* are deactivated, the exhaust gases generated by the cylinders 2 of row 3*a* cross the catalyzer 19; consequently, the electronic control unit 16 uses the signals provided by the sensors 20 to control combustion within the cylinders 2 of row 3*a*. Furthermore, the exhaust gases generated by cylinders 2 of row 3*a* also cross the catalyzer 21; however, the signals provided by the sensors 22 are ignored because they may be misrepresented due to fresh air crossing the throttle valve 5*b*. It is important to underline that also when the throttle valve 5*b* is completely closed, leakage of air through the throttle valve 5*b* itself is always possible.

It is clear that when the cylinders 2 of row 3*b* are deactivated, the catalyzer 19 is working normally and therefore is kept hot by the exhaust gases generated by the cylinders 2 of row 3*a;* furthermore, catalyzer 21 is also kept hot by the exhaust gases generated by the cylinders 2 of row 3*a*, the exhaust gases also crossing catalyzer 21.

According to a first embodiment, when the cylinders 2 of row 3*b* are deactivated, the electronic control unit 16 keeps the throttle valve 5*b* in a partially open position; in this way, the mechanical pumping work which is dissipated within the cylinders 2 of row 3*b* is reduced. On the other hand, by keeping the throttle valve 5*b* in a partially open position, fresh air is constantly introduced within the catalyzer 21 causing the catalyzer 21 itself to cool down. According to an alternative embodiment, when the cylinders 2 of row 3*b* are deactivated, the electronic control unit 16 determines the temperature within the catalyzers 21 and keeps throttle valve 5*b* in a partially open position only if the temperature within the catalyzer 21 is higher than a threshold; otherwise, i.e. if the temperature within the catalyzer 21 is lower than a threshold, then the electronic control unit 16 keeps the throttle valve 5*b* in a closed position.

According to a different embodiment, when the cylinders 2 of row 3*b* are deactivated, the electronic control unit 16 keeps the throttle valve 5*b* either always in a closed position to minimize the cooling effect or always in an open position to minimize the mechanical pumping work which is dissipated within the cylinders 2 of row 3*b*.

According to a possible embodiment shown with a broken line with FIG. 1, the exhaust conduit 7*a* comprises a bypass conduit 23 which is arranged in parallel to the catalyzer 19 whose input is regulated by a bypass valve 24. If the bypass conduit 23 is present, then all the cylinders 2 of the engine 1 are active, valve 24 is opened and the exhaust gases generated by all the cylinders 2 essentially only cross catalyzer 21; consequently, the electronic control unit 16 uses the signals from all sensors 22 to control combustion within all cylinders 2. The presence of the bypass conduit 23 allows to reduce the loss of load induced by the catalyzer 19 when all the cylinders 2 of engine 1 are active; on the other hand, when all the cylinders 2 of the engine 1 are active, the catalyzer 19 is concerned only by a minimum part of the exhaust gases generated by the cylinders 2 of row 3*a* and therefore tends to cool down. In order to avoid this drawback, the electronic control unit 16 may determine the temperature within the catalyzer 19 and keep the bypass valve 24 in an open position only if the temperature within the catalyzer 19 is higher than a threshold; otherwise, i.e. if the temperature within the catalyzer 19 is lower than the threshold, then the electronic control unit 16 keeps the bypass valve 24 in a closed position.

Figure 3:
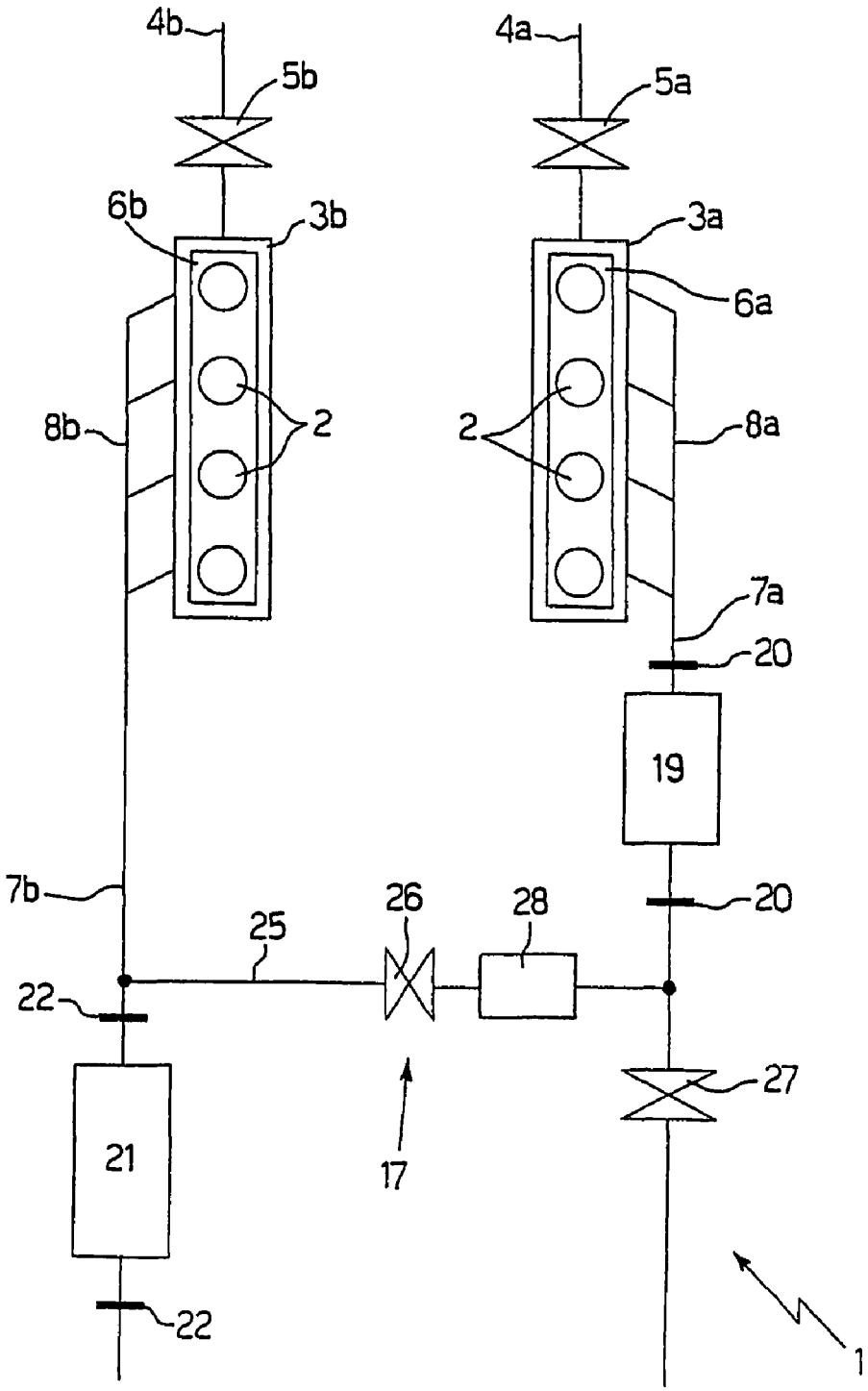
FIG. 3 is a schematic view of a different embodiment of an internal combustion engine with deactivation of part of the cylinders made according to an embodiment of the present invention.

FIG. 3 shows a different embodiment of an internal combustion engine 1; as shown in FIG. 3, the common exhaust conduit 18 is no longer present and the intersection 17 between exhaust conduit 7*a* and exhaust conduit 7*b* comprises an intersection conduit 25, which puts exhaust conduit 7*a* into communication with exhaust conduit 7*b* and is regulated by an intersection valve 26. Catalyzer 19 is again arranged along the exhaust conduit 7*a* upstream of intersection 17, while catalyzer 21 is arranged along the exhaust conduit 7*b* downstream of intersection 17 and has the same nominal capacity as catalyzer 19. Furthermore, an intersection valve 27 arranged along exhaust conduit 7*a* and downstream of intersection 17 is adapted to close the first exhaust conduit 7*a* itself.

The operation of the engine 1 shown in FIG. 3 is described below.

When all the cylinders 2 of engine 1 are active, the electronic control unit 16 opens shut-off valve 27 and also closes the intersection valve 26 so as to avoid exchanges of gases between exhaust conduit 7*a* and exhaust conduit 7*b;* consequently, the exhaust gases generated by the cylinders 2 of row 3*a* only cross exhaust conduit 7*a* and catalyzer 19, while the exhaust gases generated by the cylinders 2 of row 3*b* only cross exhaust conduit 7*b* and catalyzer 21. In such conditions, the electronic control unit 16 uses the signals provided by the sensors 20 to control combustion within the cylinders 2 of row 3*a*, and uses the signals provided by the sensors 22 to control combustion within the cylinders 2 of row 3*b*.

When cylinders 2 of row 3*b* are deactivated, the electronic control unit 16 opens intersection valve 26 and closes shut-off valve 27; in this way, the exhaust gases generated by the cylinders 2 of row 3*a* first cross catalyzer 19 and then intersection conduit 25 to reach catalyzer 21. In such conditions, the electronic control unit 16 uses the signals provided by the sensors 20 to control combustion within cylinders 2 of row 3*a* and ignores the signals provided by the sensors 22, because such signals may be misrepresented due to the fresh air crossing the throttle valve 5*b*.

It is clear than when the cylinders 2 of row 3*b* are deactivated, catalyzer 19 is working normally and therefore is kept hot by the exhaust gases generated by the cylinders 2 of row 3*a;* furthermore, also catalyzer 21 is also kept hot by the exhaust gases generated by the cylinders 2 of row 3*a*, the exhaust gases also crossing catalyzer 21.

According to an embodiment, a further catalyzer 28 is arranged along intersection conduit 25 without sensors and having relatively low performance; the function of catalyzer 28 is to ensure an at least minimum treatment of the exhaust gases generated by cylinders 2 of row 3*b* possibly leaking through the intersection valve 26 when all the cylinders 2 are active. In other words, when all the cylinders 2 are active, shut-off valve 27 is open and intersection valve 26 is closed so as to avoid the exchange of exhaust gases between exhaust conduit 7*a* and exhaust conduit 7*b;* however, exhaust gas may leak through the intersection valve from exhaust conduit 7*b* to exhaust conduit 7*a*, and such leaks could reach the exhaust conduit 7*a* downstream of the catalyzer 19. Consequently, without the presence of catalyzer 28, the exhaust gases leaking from exhaust conduit 7*b* to exhaust conduit 7*a* would be introduced into the atmosphere without coming into contact with catalytic treatment.

The engines 1 shown in FIGS. 1 and 3 may have a "flat" or a "crossed" crankshaft 14 arrangement. In the case of a "flat" crankshaft 14, when the cylinders 2 of row 3*b* are deactivated, the cylinders 2 of row 3*a* however present a regular (symmetrical) ignition distribution, i.e. one ignition every 180° rotations of the crankshaft 14. Instead, in the case of "crossed" crankshaft 14, when the cylinders 2 of row 3*b* are deactivated, the cylinders of row 3*a* present an irregular (asymmetric) ignition, i.e. one ignition does not occurs at every 180° rotation of the crankshaft 14; such irregular distribution of the ignitions entails a higher quantity of uncompensated harmonics and therefore increased vibrations.

Two solutions shown in FIGS. 4 and 5 have been proposed to avoid the drawback described above; in other words, FIGS. 4 and 5 show two different embodiments of an engine 1 having a "crossed" crankshaft 14 and presenting regular ignition distribution in all operating conditions.

In the engines 1 of FIGS. 1 and 3, the electronic control unit deactivates all cylinders 2 of row 3*b*, i.e. the cylinders 2 are divided into two groups coinciding with the two rows 3 and all cylinders 2 of the same row coinciding with row 3*b* are deactivated. On the contrary, in the engines 1 in FIGS. 4 and 5, the cylinders 2 are split into two groups not coinciding with the two rows 3; in particular, a first group of cylinders 2 which always remains active comprises the two external cylinders 2 of row 3*a* and the two internal cylinders 2 of row 3*b*, while a second group of cylinders which is deactivated when required comprises the two internal cylinders 2 of row 3*a* and the two external cylinders 2 of row 3*b*.

Figure 4:
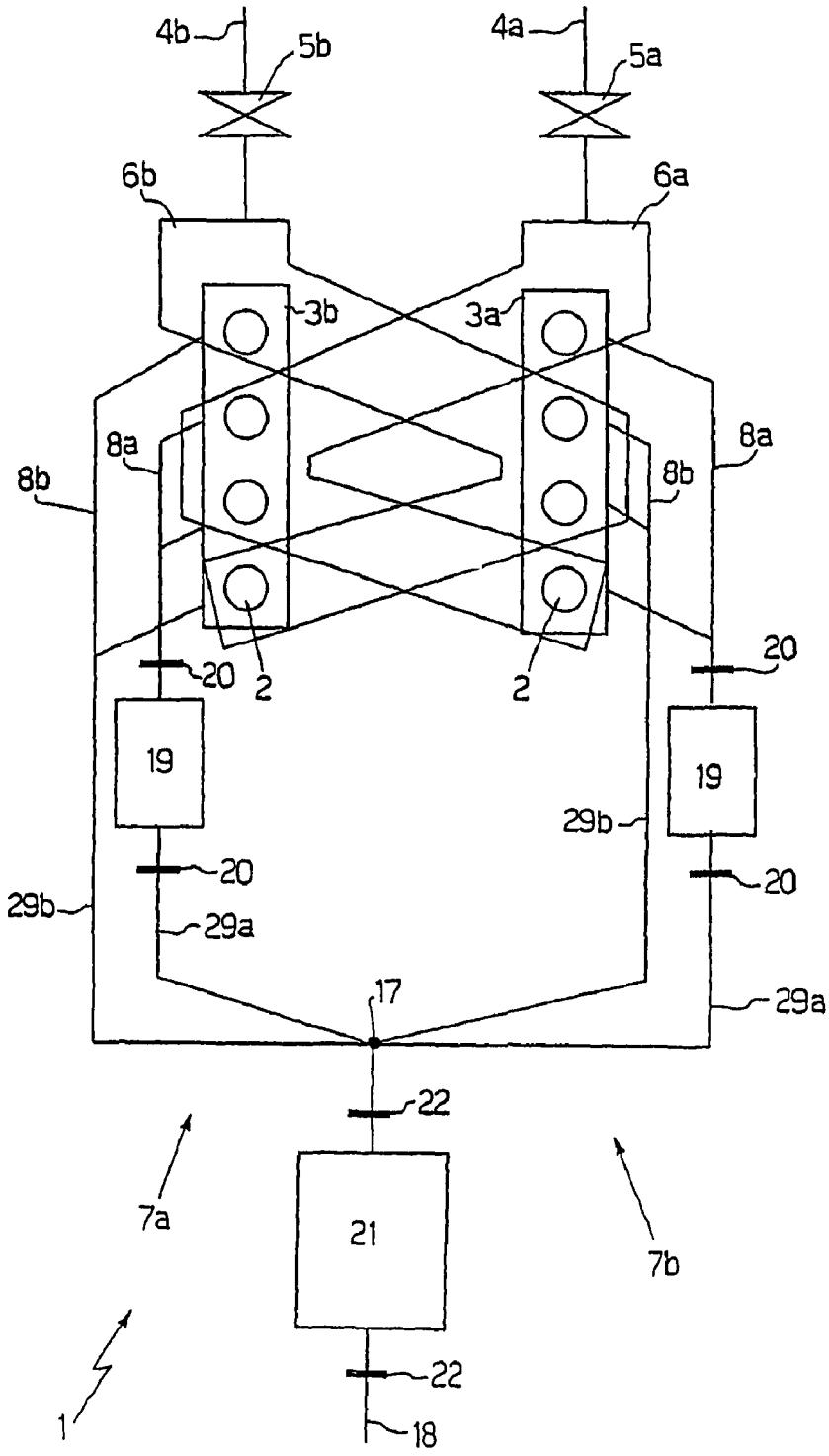
FIG. 4 is a schematic view of a further embodiment of an internal combustion engine with deactivation of part of the cylinders made according to an embodiment of the present invention.
Figure 5:
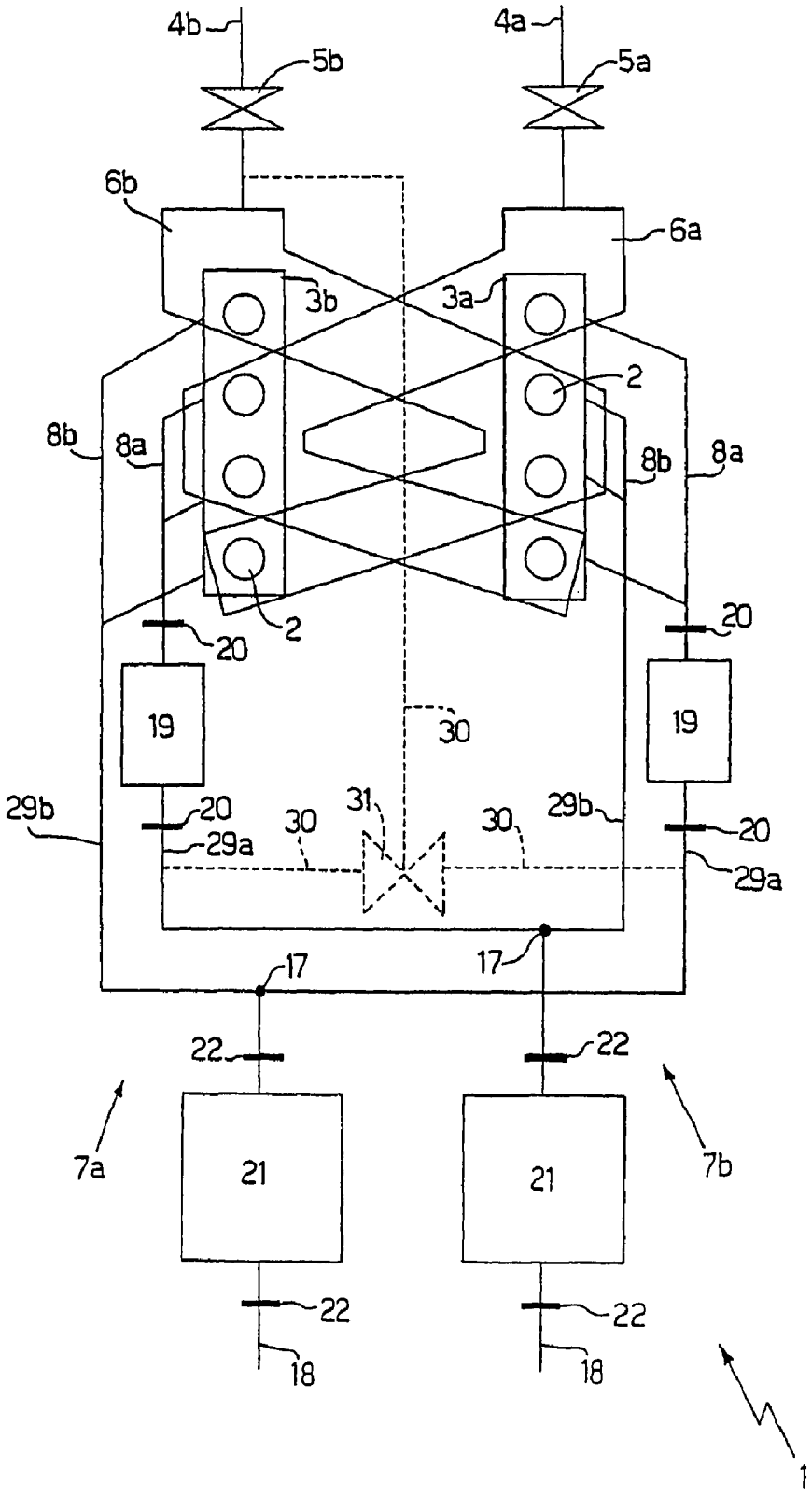
FIG. 5 is a schematic view of an alternative embodiment of an internal combustion engine with deactivation of part of the cylinders made according to an embodiment of the present invention.

As shown in FIGS. 4 and 5, two separate and crossed intake manifolds 6 are provided, each of which communicates with an intake conduit 4 and is "V" shaped to feed fresh air to all cylinders 2 of the same group of cylinders 2; in other words, each intake manifold 6 is "V" shaped to feed fresh air both to two cylinders 2 of row 3*a* and to two cylinders 2 of row 3*b*.

Furthermore, each exhaust conduit 7 is crossed and comprises a pair of exhaust manifolds 8, each of which is associated to one of the rows 3, and a pair of half exhaust conduits 29, each of which is connected to one of the exhaust manifolds 8. In other words, each exhaust conduit 7 receives the exhaust gas produced by all the cylinders 2 of a same group of cylinders 2 by means of an exhaust manifold 8 connected to two cylinders 2 of row 3*a* and by means of a further exhaust manifold 8 connected to two cylinders 2 of row 3*b*. Each exhaust manifold 8 receives exhaust gases produced by the two cylinders 2 of the same row 3 and feeds the exhaust gases themselves to a half exhaust conduit 29 of their own.

As shown in FIG. 4, the exhaust manifold 7*a* and the exhaust manifold 7*b* are connected together at intersection 17, where exhaust conduit 7*a* and exhaust conduit 7*b* join to form a common exhaust conduit 18. In particular, the two half exhaust conduits 29*a* of exhaust conduit 7*a* and two half exhaust conduits 29*b* of exhaust conduit 7*b* join at intersection 17 to form common exhaust conduit 18.

According to a different embodiment (not shown), the two half exhaust conduits 29*a* of exhaust conduit 7*a* are joined together upstream of intersection 17 and two half exhaust conduits 29*b* of exhaust conduit 7*b* 7*a* are joined together upstream of intersection 17.

A pair of catalyzers 19 is present along exhaust conduit 7*a* is present, each of which is arranged along an half exhaust conduit 29*a* (i.e. upstream of intersection 17) and is provided with sensors 20 to detect the composition of the exhaust gases upstream and downstream of the catalyzer 19; in other words, each catalyzer 19 is arranged between one of the two exhaust manifolds 8*a* and intersection 17. A catalyzer, whose nominal capacity is double that of each catalyzer 21, is present along the common exhaust conduit 18 (i.e. downstream of intersection 17) and is provided with sensors 22 for detecting the composition of exhaust gases upstream and downstream of the catalyzer 21 itself.

The operation of the engine shown in FIG. 1 is described below.

When all the cylinders 2 of the engine 1 are active, the exhaust gases generated by the cylinders 2 of the first group cross the catalyzers 19; consequently, the electronic control unit 16 uses the signals provided by the sensors 20 to control combustion within the cylinders 2 of the first group. Furthermore, when all the cylinders of the engine 1 are active, the exhaust gases generated by the cylinders 2 of the second group cross the catalyzer 21 along with the exhaust gases generated by the cylinders 2 of the first group; consequently, the electronic control unit 16 uses the difference between the signals provided by the sensors 22 and the signals provided by the sensors 20 (i.e. performs a differential reading) to control combustion within the cylinders 2 of the second group.

When all the cylinders 2 of the second group are deactivated, the exhaust gases generated by the cylinders 2 of the first group cross the catalyzers 19; consequently, the electronic control unit 16 uses the signals provided by the sensors 20 to control combustion within the cylinders 2 of the first group. Furthermore, the exhaust gases generated by cylinders 2 of the first group also cross the catalyzer 21; however, the signals from 22 are ignored because they may be misrepresented due to the fresh air crossing the throttle valve 5*b*.

It is clear than when the cylinders 2 of the second group are deactivated, the catalyzer 19 is working normally and therefore is kept hot by the exhaust gases generated by the cylinders 2 of the first group; furthermore, catalyzer 21 is also kept hot by the exhaust gases generated by the cylinders 2 of the first group, the exhaust gases also crossing catalyzer 21.

As shown in FIG. 5, each half exhaust conduit 29*a* of exhaust conduit 7*a* joins a respective half exhaust conduit 29*b* of exhaust conduit 7*b* at an intersection 17; downstream of each intersection 17, the two half exhaust conduits 29*a* and 29*b* which lead to intersection 17 itself are joined to form a common exhaust conduit 18, along which a catalyzer 21 is arranged. It is therefore clear that two intersections 17 are provided, upstream of which are provided two common exhaust conduits 18 provided with respective catalyzers. Each catalyzer 21 presents a nominal capacity double that of each catalyzer 19.

The operation of the engine shown in FIG. 1 is described below.

When all the cylinders 2 of engine 1 are active, the exhaust gases generated by the cylinders 2 of the first group cross catalyzers 19; consequently, the electronic control unit 16 uses the signals provided by the sensors 20 to control combustion within the cylinders 2 of the first group. Furthermore, when all the cylinders of the engine 1 are active, the exhaust gases generated by the cylinders 2 of the second group cross the catalyzers 21 along with the exhaust gases generated by the cylinders 2 of the first group; consequently, the electronic control unit 16 uses the difference between the signals provided by the sensors 22 and the signals provided by the sensors 20 (i.e. performs a differential reading) to control combustion within the cylinders 2 of the second group.

When all the cylinders 2 of the second group are deactivated, the exhaust gases generated by the cylinders 2 of the first group cross the catalyzers 19; consequently, the electronic control unit 16 uses the signals provided by the sensors 20 to control combustion within the cylinders 2 of the first group. Furthermore, the exhaust gases generated by cylinders 2 of the first group also cross the catalyzers 21; however, the signals provided by the sensors 22 are ignored because they may be misrepresented due to the fresh air crossing the throttle valve 5*b*.

It is clear than when the cylinders 2 of the second group are deactivated, the catalyzer 19 is working normally and therefore is kept hot by the exhaust gases generated by the cylinders 2 of the first group; furthermore, also the catalyzers 21 are kept hot by the exhaust gases generated by the cylinders 2 of the first group, the exhaust gases also crossing catalyzers 21.

According to a possible embodiment shown by a broken line in FIG. 5, it is provided a recirculation conduit 30 which is regulated by a recirculation valve 31 and puts exhaust conduit 7*a* into communication with feeding conduit 4*b*. The recirculation conduit 30 is inserted in the feeding conduit 4*b* downstream of the second throttle valve 5*b* and is inserted in the exhaust conduit 7*a* downstream of the catalyzer 19. The recirculation valve 31 may be opened when the cylinders 2 of the second group are deactivated so as to take part of the exhaust gases generated by the cylinders 2 of the first group and force such exhaust gases through the cylinders 2 of the second group; the function of such recirculated exhaust gases is to heat the cylinders 2 of the second group. It is important to underline that the recirculation conduit 30 described above may be provided with similar modalities also for the engines illustrated in FIGS. 1, 3 and 4.

According to a further embodiment (not shown), the two half exhaust conduits 29 of exhaust conduit 7*a* are joined together upstream of the first catalyzer 19 and the two half exhaust conduits 29 of exhaust conduit 7*b* are joined together upstream of intersection 17.

Figure 6:
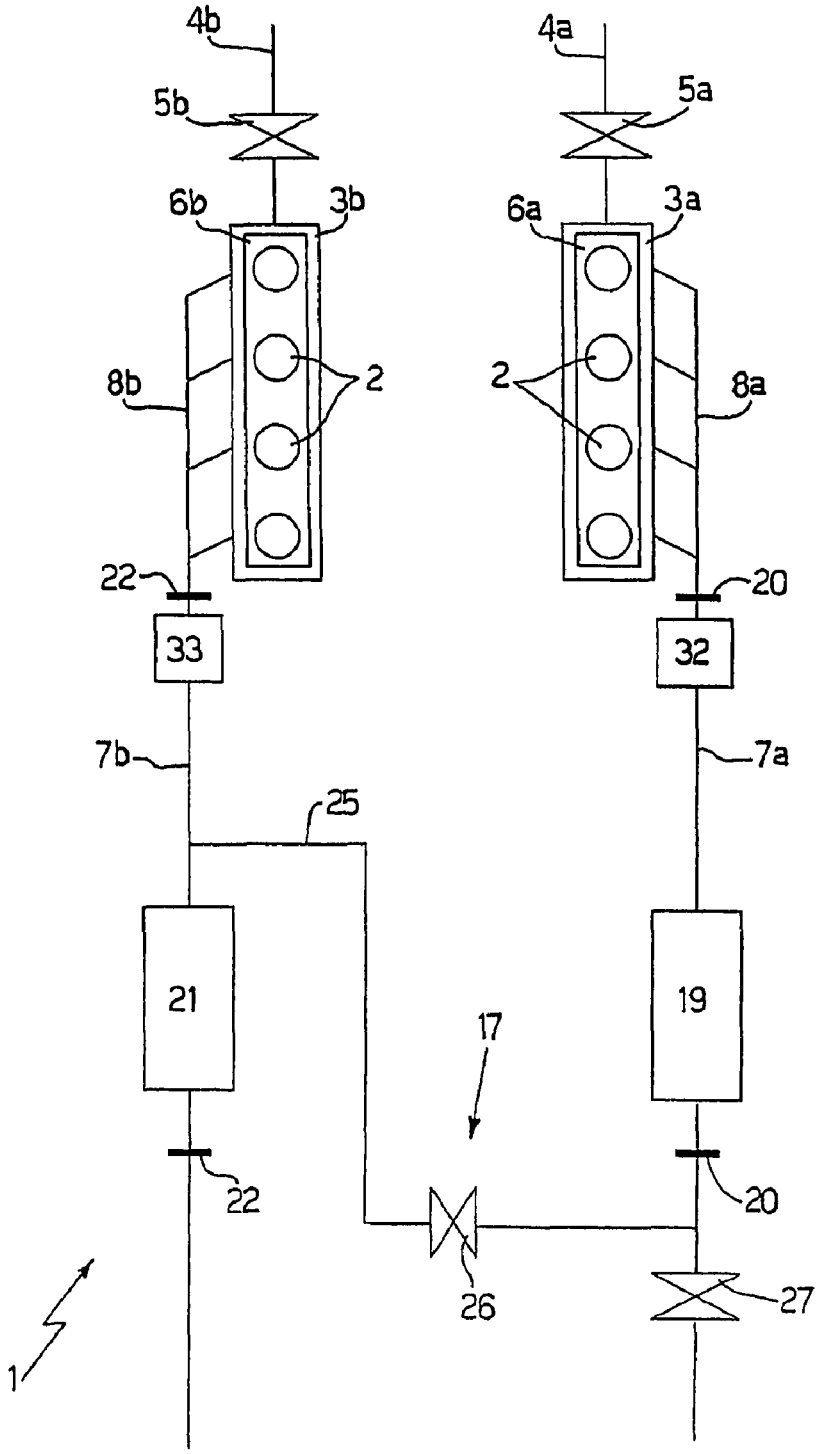
FIG. 6 is a schematic view of a variant of the embodiment in FIG. 3.

FIG. 6 shows a variant of the embodiment shown in FIG. 3; as shown in FIG. 6, intersection 17 between exhaust conduit 7*a* and exhaust conduit 7*b* comprises intersection conduit 25, which puts exhaust conduit 7*a* into communication with exhaust conduit 7*b* and is regulated by an intersection valve 26. Catalyzer 19 is again arranged along exhaust manifold 7*a* upstream of intersection 17, while catalyzer 21 is arranged along exhaust conduit 7*b* downstream of intersection 17 and has the same nominal capacity as catalyzer 19. Furthermore, an intersection valve 27 adapted to close the first exhaust conduit 7*a* itself is arranged along exhaust conduit 7*a* and downstream of intersection 17.

A pre-catalyzer 32 is arranged along exhaust conduit 7*a* upstream of catalyzer 19; furthermore, a pre-catalyzer 33 is arranged along exhaust conduit 7*b* upstream of catalyzer 21 and upstream of intersection 17. Sensors 20 are arranged one upstream of pre-catalyzer 32 and one downstream of catalyzer 19; sensors 22 are arranged one upstream of the pre-catalyzers 33 and one downstream of catalyzer 21.

The operation of the engine shown in FIG. 1 is described below.

When all the cylinders 2 of the engine 1 are active, the electronic control unit 16 opens the shut-off valve 27 and furthermore closes the shut-off valve 26 so as to avoid exchanges of gases between exhaust conduit 7*a* and exhaust conduit 7*b*; consequently, the exhaust gases generated by the cylinders 2 of row 3*a* only cross exhaust conduit 7*a* and catalyzer 19, while the exhaust gases generated by the cylinders 2 of row 3*b* only cross exhaust conduit 7*b* and catalyzer 21. In such conditions, the electronic control unit 16 uses the signals provided by the sensors 20 to control combustion within the cylinders 2 of row 3*a*, and uses the signals provided by the sensors 22 to control combustion within the cylinders 2 of row 3*b*.

When cylinders 2 of row 3*b* are deactivated, the electronic control unit 16 opens intersection valve 26 and closes shut-off valve 27; in this way, the exhaust gases generated by the cylinders 2 of row 3*a* first cross catalyzer 19 and then intersection conduit 25 to reach catalyzer 21. In such conditions, the electronic control unit 16 uses the signals provided by the sensors 20 to control combustion within cylinders 2 of row 3*a* and ignores the signals provided by the sensors 22, because such signals may be misrepresented due to the fresh air crossing the throttle valve 5*b*.

It is clear than when the cylinders 2 of row 3*b* are deactivated, catalyzer 19 is working normally and therefore is kept hot by the exhaust gases generated by the cylinders 2 of row 3*a*; furthermore, also catalyzer 21 is also kept hot by the exhaust gases generated by the cylinders 2 of row 3*a*, the exhaust gases also crossing catalyzer 21. When the cylinders 2 of row 3*b* are deactivated, pre-catalyzer 32 is kept hot by the exhaust gases generated by cylinders 2 of row 3*a*, while pre-catalyzer 33 is not heated and therefore tends to cool down; however, the fact that pre-catalyzer 33 cools down is not a problem because catalyzer 21 arranged downstream of pre-catalyzer 33 is kept hot.

In the embodiment shown in FIG. 6, the presence of a further catalyzer 28 is not necessary, due to the presence of pre-catalyzer 33, which ensures an at least minimum treatment of the exhaust gases generated by cylinders 2 of row 3*b* which could leak through intersection valve 26 when all cylinders 2 are active.

With respect to the embodiment shown in the figure, the embodiment in FIG. 6 presents a greater symmetry between the two rows 3 allowing to obtain a better running balance of engine 1. It is important to underline that the pre-catalyzers 32 and 33 described above may also be present in the engine shown in FIGS. 1, 5 and 5.

Obviously, the above may also be applied to an engine 1 having a number cylinders 2 other than 8 (for example 6, 10 or 12), in "V", double-"V" or counterpoised (boxer) arrangement.

The engines 1 described above are simple and cost-effective to make because they do not require the presence of mechanical decoupling devices for keeping part of the suction valves 9 and/or the exhaust valves 10 in a closed position when part of the cylinders 1 are deactivated. Furthermore, when part of the cylinders 2 are deactivated, all of the catalyzers 19 and 21 are kept hot; therefore when the deactivated cylinders 2 are reactivated all the catalyzers 19 and 21 present optimal, or at least reasonable, efficiency.

From the foregoing it will be appreciated that, although specific embodiments of the invention have been described herein for purposes of illustration, various modifications may be made without deviating from the spirit and scope of the invention.

The invention claimed is:

1. An internal combustion engine comprising:

a plurality of cylinders divided into a first group and into a second group;

a control unit to deactivate all cylinders of the second group;

a first intake conduit and a second intake conduit, which are connected respectively to the cylinders of the first group and to the cylinders of the second group and are controlled respectively by a first throttle valve and by a second throttle valve;

at least one first exhaust conduit and at least one second exhaust conduit, which are connected respectively to the cylinders of the first group and to the cylinders of the second group;

an intersection at which the first exhaust conduit and the second exhaust conduit are reciprocally connected;

at least one catalyzer, which is arranged along the first exhaust conduit upstream of the intersection and is provided with first sensors to detect the composition of exhaust gases at the first catalyzer itself; and at least one second catalyzer, which is arranged downstream of the intersection and is provided with second sensors to detect the composition of exhaust gases a the second catalyzer itself;

wherein the intersection between the first exhaust conduit and the second exhaust conduit comprises an intersection conduit, which is regulated by an intersection valve.

2. An engine according to claim 1, wherein each cylinder comprises at least one suction valve to regulate the flow of air introduced from the intake conduit, at least one exhaust valve to regulate the flow of air output towards the exhaust conduit, and an injector to inject fuel within the cylinder itself; to deactivate all the cylinders of the second group the control unit cuts off fuel supply to the cylinders of the second group by acting on the injectors without intervening in any way on the actuation of the suction and exhaust valves, which continue to be operated.

3. An engine according to claim 2, wherein all cylinders of the second group are deactivated, the control unit keeping the second throttle valve in a partially open position.

4. An engine according to claim 2, wherein when all the cylinders of the second group are deactivated, the control unit determines the temperature within the second catalyzer and keeps the throttle valve in a partially open position only if the temperature within the second catalyzer is higher than a threshold.

5. An, engine according to claim 1, wherein a recirculation conduit is provided, the conduit is regulated by a recirculation valve and puts into communication the first exhaust conduit with the second feeding conduit.

6. An engine according to claim 5, wherein the recirculation conduit is inserted in the second feeding conduit downstream of the second throttle valve and is inserted in the first exhaust conduit downstream of the first catalyzer.

7. An engine according to claim 1, wherein when all the cylinders of the engine are active the electronic control unit uses the signals from the first sensors to control combustion within the cylinders of the first group and uses the difference between the signals from the second sensors and the signals from the first sensors to control combustion within the cylinders of the second group; when all the cylinders of the second group are deactivated, the electronic control unit uses only the signals from the first sensors to control combustion within the cylinders of the first group.

8. An engine according to claim 1, wherein at least one pre-catalyzer is provided, which is arranged along the first exhaust conduit upstream of the first catalyzer, and at least one second pre-catalyzer, which is arranged along the second exhaust conduit upstream of the second catalyzer and upstream of the intersection.

9. An engine according to claim 8, wherein the first sensors are arranged one upstream of the first pre-catalyzer and one downstream of the first catalyzer; the second sensors are arranged one upstream of the second pre-catalyzer and one downstream of the second catalyzer.

10. An engine according to claim 1, wherein each exhaust conduit comprises one single exhaust manifold communicating with all the cylinders associated to the exhaust conduit itself.

11. An engine according to claim 10, wherein the cylinders are divided into a first row coinciding with the first group of cylinders and in a second row coinciding with the second group of cylinders.

12. An engine according to claim 10, wherein in the intersection the first exhaust conduit and the second exhaust conduit join to form a common exhaust conduit, along which is arranged the second catalyzer is arranged.

13. An engine according to claim 12, wherein the nominal capacity of the second catalyzer is double that of the first catalyzer.

14. An engine according to claim 12, wherein the first exhaust conduit comprises a bypass conduit, which is arranged in parallel to the first catalyzer and whose input is regulated by a bypass valve.

15. An engine according to claim 14, wherein when all the cylinders are activate, the control unit determines the temperature within the first catalyzer and keeps the bypass valve in an open position only if the temperature within the first catalyzer is higher than a threshold.

16. An engine according to claim 1, wherein the second catalyzer is arranged along the second exhaust conduit downstream of the intersection; along the first exhaust conduit and downstream of the intersection is arranged an intersection valve adapted to close the first exhaust conduit itself.

17. An engine according to claim 16, wherein along the intersection conduit a third catalyzer is arranged.

18. An engine according to claim 17, wherein the third catalyzer is without sensors.

19. An engine according to claim 16, wherein the nominal capacity of the second catalyzer is the same as that of the first catalyzer.

20. An engine according to claim 1, wherein all the cylinders are divided into a first row and a second row and the cylinders of each group of cylinders are arranged on both the first row and the second row; each exhaust conduit receiving exhaust gases from the cylinders arranged on both rows and comprising two exhaust manifolds, each of which is associated to one of the rows; each exhaust conduit is split to comprise to half exhaust conduits, each of which is connected to one of the exhaust manifolds.

21. An engine according to claim 20, wherein each half exhaust conduit of the first exhaust conduit comprises a first catalyzer provided with first sensors for detecting the composition of exhaust gases upstream and downstream of the first catalyzer itself.

22. An engine according to claim 21, wherein the two half exhaust conduits of the first exhaust conduit are joined at the intersection.

23. An engine according to claim 21, wherein the two half exhaust conduits of the first exhaust conduit are joined upstream of the intersection.

24. An engine according to claim 22, wherein in the intersection the first exhaust conduit and the second exhaust conduit join to form a common exhaust conduit, along which the second catalyzer is arranged.

25. An engine according to claim 24, wherein the nominal capacity of the second catalyzer is double that of each first catalyzer.

26. An engine according to claim 21, wherein each half exhaust conduit of the first exhaust conduit joins with a second half exhaust conduit of the second exhaust conduit at an intersection, upstream of which the two half exhaust conduits join to form a common exhaust conduit, along which is arranged a second catalyzer.

27. An engine according to claim 26, wherein the nominal capacity of each second catalyzer is double that of each first catalyzer.

28. An engine according to claim 21, wherein the two half exhaust conduits of the first exhaust conduit join upstream of the first catalyzer; the two half exhaust conduits of the second exhaust conduit join upstream of the intersection.

* * * * *